United States Patent [19]

Cook et al.

[11] Patent Number: 4,895,012

[45] Date of Patent: Jan. 23, 1990

[54] METHOD AND APPARATUS FOR TRANSFERRING RELATIVELY FLAT OBJECTS

[75] Inventors: Steven T. Cook, Bellbrook; James R. Gregg, Springboro, both of Ohio

[73] Assignee: Dayton Reliable Tool & Mfg. Co., Dayton, Ohio

[21] Appl. No.: 238,651

[22] Filed: Aug. 30, 1988

Related U.S. Application Data

[63] Continuation-in-part of Ser. No. 19,734, Feb. 27, 1987, Pat. No. 4,770,022.

[51] Int. Cl.[4] ..... B21D 45/04

[52] U.S. Cl. ..... 72/361

[58] Field of Search ..... 413/62, 65; 83/111, 83/112; 72/345, 361, 427

[56] References Cited

U.S. PATENT DOCUMENTS

| | | | |
|---|---|---|---|
| 2,633,890 | 4/1953 | Rozanek | 72/427 |
| 3,413,835 | 12/1968 | Master | 72/361 |
| 3,670,554 | 6/1972 | Kienzler et al. | 72/361 |
| 4,043,168 | 8/1977 | Mazurek | 72/345 |
| 4,364,255 | 12/1982 | Byrd | 72/345 |
| 4,554,814 | 11/1985 | Grow et al. | 72/427 |

*Primary Examiner*—Lowell A. Larson

*Attorney, Agent, or Firm*—Biebel, French & Nauman

[57] ABSTRACT

An apparatus for transferring a relatively flat object from a work station along a transfer path includes an upper tooling within the work station for locating the object in a ready position by causing an upper surface of the object to adhere to the tooling. The object is thus unsupported along its lower surface. A manifold forming at least one orifice is located adjacent to and directed toward the ready position, and is connected to a source of pressurized gas. A valve initiates and discontinues flow of pressurized gas through the orifice. A control system controls the valve to direct a stream of pressurized gas through the orifice as or before an object is located in the ready position, thereby causing the transfer of the object in free flight from the work station.

16 Claims, 7 Drawing Sheets

METHOD AND APPARATUS FOR TRANSFERRING RELATIVELY FLAT OBJECTS

RELATED APPLICATION

This is a continuation-in-part of U.S. patent application Ser. No. 019,734, filed Feb. 27, 1987 now U.S. Pat. No. 4,770,022 granted Sept. 13, 1988.

BACKGROUND OF THE INVENTION

The present invention relates to a method and apparatus for the transfer of relatively flat objects from a first work station and, more particularly, to the means by which the object to be transferred is propelled from the work station. The present invention is especially adapted for use within equipment for the manufacture of shells used to close the ends of metal cans.

One common way of packaging liquids, foods and other products, particularly beer, soft drinks, juices and the like, is within cans typically formed from aluminum or steel. In such cans, the can body is either manufactured to include both the can side walls and an attached bottom end, or the bottom end is formed separately and subsequently joined to the side walls. The upper end, which includes the means by which the can is later opened, is manufactured separately and attached to the can body after the can has been filled. The can ends, often referred to within the art as shells, are generally manufactured within ram presses. While various particular methods of shell formation are known and available, it is often necessary as a part of these methods to transfer the shells from a first to a succeeding work station. In any case, it is also necessary to transfer the shells from a work station out of the press. In view of the large quantities of cans and shells that are manufactured, it is desirable to be able to form quantities of the shells very rapidly. This necessitates a transfer system that is both quick and reliable.

Various types of transfer systems for shells are known. In one approach, the shell is partially formed within the first tooling station and then positioned for transfer. A device is actuated to strike the shell with an edgewise blow that propels the shell outwardly from the tooling. The shell moves laterally along a transfer path either out of the press for further processing, or to a second station within the press for additional operations.

An example of this type of transfer system may be seen in U.S. Pat. No. 4,561,280. There, a driver extends an actuator to provide the blow for moving the shell along the transfer path. Ideally, the shell moves in free flight without contacting the restraining structure defining the path until the shell is captured at the second station. This system has been found to work well. However, it is not unusual for shell forming presses to be operated at speeds in excess of 24,000 strokes per hour. Such rapid and repetitive action takes a significant toll on mechanical devices. Thus, while the driver described above is specifically designed for speed and reliability, failures of the mechanical drivers would not be totally unexpected. Moreover, it would not be unusual for the driver mechanism to develop an unwanted sticking effect, whereby extension or retraction of the shell driving actuator could be slightly delayed.

Particularly where a shell is being transferred into a second work station within the same press, speed and consistency in transfer times is of great importance. Thus, it is not only necessary that the shell drivers continue to function, but that they continue to operate with optimum performance. Otherwise, shells could be delayed in being discharged from the press work station. While it might be possible to provide detectors for determining the occasional late arrival of shells at a second station, there is no practical way of delaying operations in the stations since such operations are under the control of the press drive. With the press running at speeds of several hundred strokes per minute, the timing of individual strokes cannot be altered. Thus, a late arriving shell could be subjected to forming or other work steps prior to proper positioning within the tooling. At best, this result in a deformed workpiece, but could also cause disruption of the manufacturing process requiring restarting of the press, removal of lodged workpieces, or even repair to damage to the press tooling itself It can be seen, therefore, that any improvement in the transfer mechanism for moving shells from a press tooling and directing them into a transfer path is advantageous. Such improvements that increase either the speed or reliability of the transfer process will be reflected in a smaller number of defective shells and greater reliability of the press operation as a whole.

SUMMARY OF THE INVENTION

In meeting the foregoing needs, the present invention provides an apparatus for transferring a relatively flat object from a work station along a transfer path. Means located within the work station locates the object in a ready position by causing an upper surface of the object to adhere to the locating means, whereby the object is unsupported along a lower surface thereof. An orifice defining means is located adjacent to the ready position for defining an orifice directed toward the ready position. Supply means connected to the orifice defining means connects the orifice defining means to a source of pressurized gas. Valve means disposed within the supply means initiates and discontinues flow of pressurized gas through the orifice defining means. A control means controls the valve means such that the object is transferred in free flight from the work station.

In accordance with the invention, the orifice defining means may define a plurality of orifices, each directed toward the ready position at an angular relationship with respect to the other orifices. A manifold means interconnects the orifices. The supply means is in turn connected to the manifold means. The control means controls the valve means to direct a stream of pressurized gas through the orifices toward said ready position at least when an object is located in the ready position to cause he transfer of the object.

The orifice defining means may define the orifices so as to form the streams of pressurized gas along mutually converging paths toward the ready position. These mutually converging paths should converge near the center of an object supported in the ready position.

Preferred embodiments of the invention include two or three orifices, although a greater number may be used.

According to another embodiment of the invention, the orifice defining means located adjacent to the ready position defines at least one orifice directed toward the ready position. The control means which controls the valve means to direct a stream of pressurized gas through the orifice operates such that the stream is initiated prior to location of an object in the ready position. As a result, transfer of the object in free flight from the work station is caused as the object is located into the ready position.

The object locating means may include a lower surface, with the lower surface defining therein a vacuum opening. A source of vacuum connected to the vacuum opening causes the object to adhere to the lower surface.

The object locating means may be a portion of a vertically-acting, reciprocating tooling set for working upon the object, the lower surface being defined on an upper tooling of the set. The ready position may be defined at an upper portion of a stroke of the tooling set.

The tooling set may include a blank punch disposed as the outermost portion of the tooling set, the blank punch being constructed to punch a blank from a sheet of stock material. The object locating means is defined on a portion of the tooling set disposed radially inward of the blank punch. The blank punch is raised to its uppermost stroke position subsequent to location of the object locating means at the ready position, whereby the blank punch shields the object from the stream of pressurized gas until the blank punch is raised past the ready position.

According to another embodiment, the invention is incorporated within a reciprocating ram press having a vertically-operating tooling set within each of a plurality of work stations for separating blanks from a sheet of stock material and for forming the blanks into relatively flat objects, and means for transferring each object from its corresponding work station along a transfer path.

Each of the tooling sets has an upper tooling including means for locating an object in a ready position by causing an upper surface of the object to adhere to the upper tooling, whereby the object is unsupported along a lower surface thereof. Orifice defining means is located adjacent to the ready position at each of the work stations for defining at least one orifice directed toward the ready position. A supply means is connected to each of the orifice defining means for connecting all of the orifice defining means to a source of pressurized gas.

A single valve means is disposed within the supply means but remote from the work stations for initiating and discontinuing flow of pressurized gas through all of the orifice defining means. Control means controls the valve means to direct streams of pressurized gas through the orifices at least when the objects are located in the ready position, thereby causing the simultaneous transfer of the objects in free flight from the work stations along the transfer paths.

The supply means may include a manifold connected to the source of pressurized gas and a plurality of supply lines, one of the supply lines being connected between the manifold and each of the orifice defining means.

Accordingly, it is an object of the present invention to provide apparatus and a method for transferring a relatively flat object from a work station along a transfer path; to provide such apparatus and method that is particularly adapted for use within a reciprocating ram press; to provide such apparatus and method that is particularly adapted to transfer shells used for closing metal cans; to provide such apparatus and method that is usable with shells of varying materials and weights; to provide such apparatus and method that is usable to transfer shells either from a first partial forming station to a second, succeeding forming station, or from a forming station out of the press; to provide such apparatus and method that can increase the speed with which transfers of such shells are made; to provide such apparatus and method that can increase the reliability with which transfers of such shells are made; to provide such apparatus and method that can increase the output of shells from the press; and to provide such apparatus and method that can decrease the number of shells damaged as a result of improper transfer.

Other objects and advantages of the invention will be apparent from the following description, the accompanying drawings, and the appended claims.

DETAILED DESCRIPTION OF THE PREFERRED EMBODIMENTS

Figure 1:
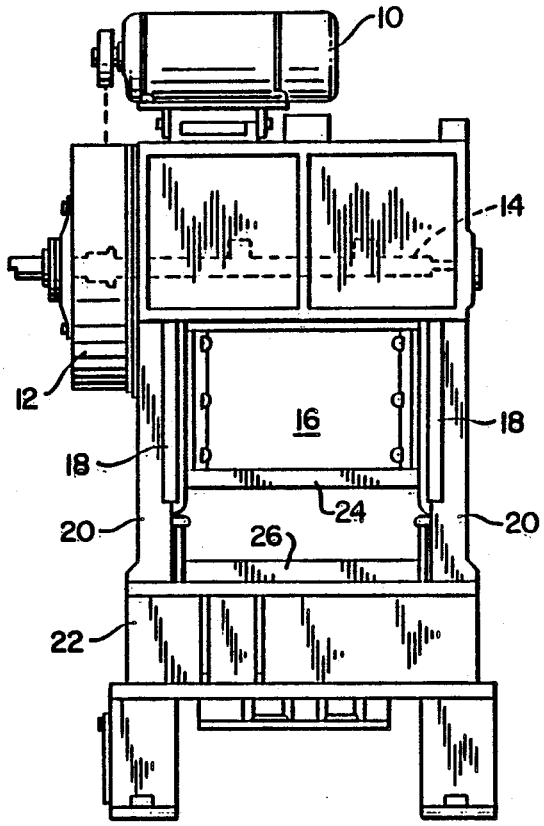
FIGS. 1 and 2 are, respectively, front and side views of a typical single acting ram press as utilized in the present invention.
Figure 2:
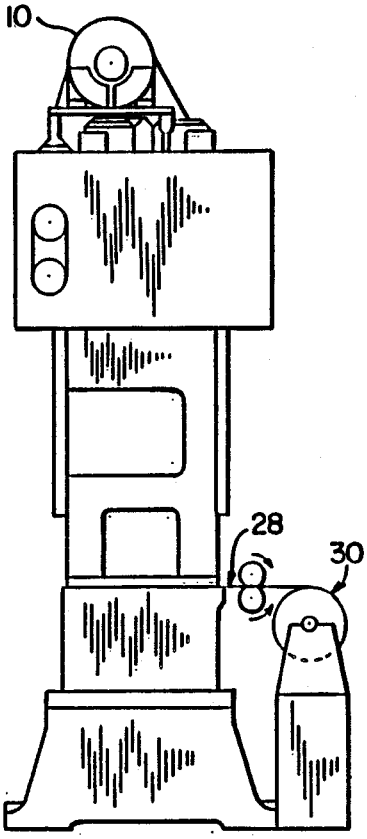

Referring now to the drawings, a typical ram press used in the manufacturing of shells for can ends is shown generally in FIGS. 1 and 2. The press includes a drive motor 10 coupled to a flywheel 12 on the press crankshaft 14 which reciprocates the ram 16 along gibs 18 that are mounted to posts 20 extending upwards from the press bed 22. Upper tooling is fixed at 24 to the bottom of ram 16, and cooperating lower tooling is fixed at 26 to the top of bed 22. The relatively thin metal stock 28 from which the shells are formed is fed incrementally from a roll 29 into the front of the press.

The present invention is not dependent upon any specific method of shell formation, so long as the shells are at least partially formed with the ram press and transferred from the forming tooling. Thus, any one of a variety of methods may be used. In one preferred method, a two-step process requiring two separate toolings for each shell to be formed is used. At the first tooling, a blank is punched from the sheet of stock material. Into the blank is formed a substantially flat central panel and an upwardly extending chuckwall about the edge of the panel to produce a partially formed shell. The partially formed shell is then transferred to a second tooling within the same press, where the shell is captured and located. At this tooling, a countersink is formed into the shell at the base of the chuckwall by moving the panel upward relative to the chuckwall to produce a completed shell. Portions of this method and the necessary apparatus are described in detail below; further details may be found in commonly-assigned U.S. Pat. No. 4,561,280 of Bachmann et al, issued Dec. 31, 1985, which is hereby incorporated by reference.

However, it is not necessary that the two-step method disclosed in the above-referenced patent be used. For example, a method in which the forming that occurs within the press takes place at only a single station would also be appropriate, as is shown in either U.S. Pat. No. 4,382,737 of Jensen et al, or U.S. Pat. No. 3,537,291 of Hawkins. With such a method, finishing of the shells is performed following their ejection from the press.

Figure 3:
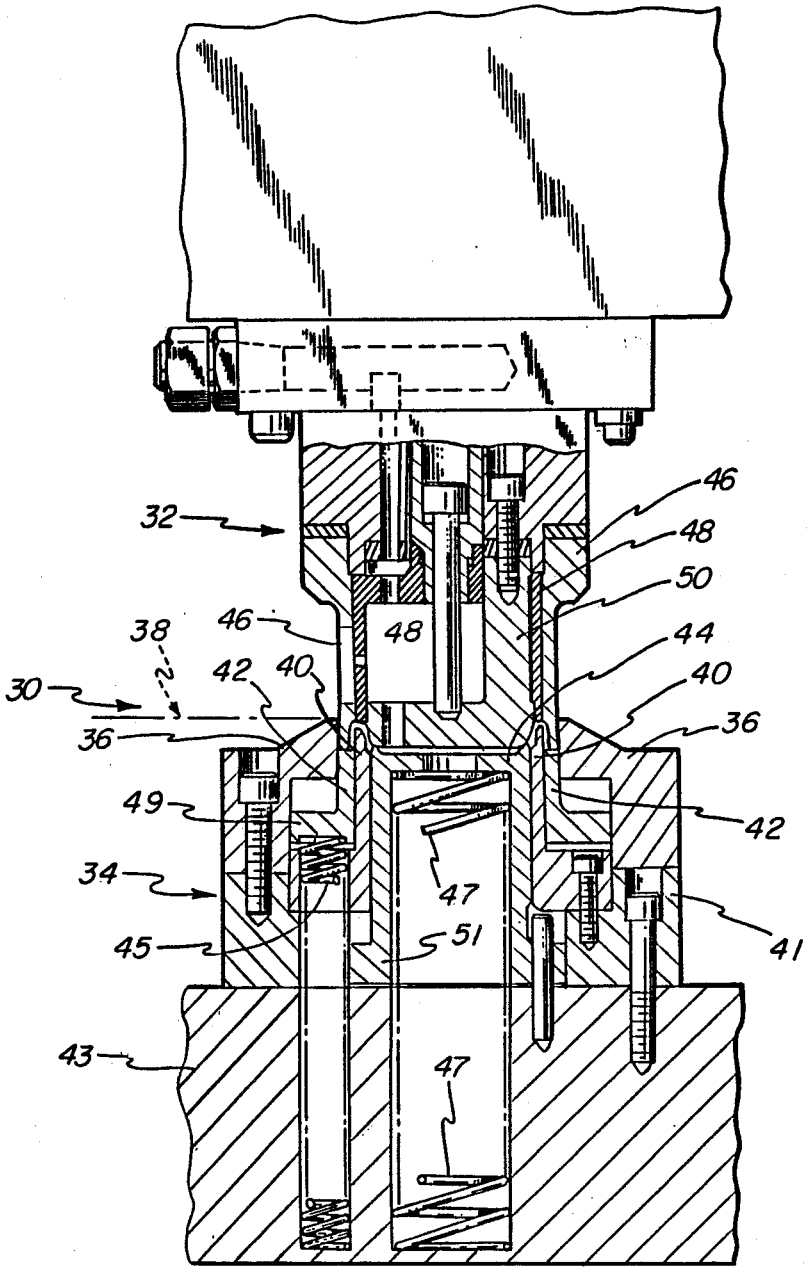
FIG. 3 is a cross-sectional view illustrating the tooling of a first station within the shell-forming apparatus with which the present invention is used.

For the preferred shell-making method and apparatus, the press tooling for each of the first stations 30 (or first stage of the method) is shown generally in FIG. 3. The upper tooling 32 is connected for operation by the press ram, while the lower tooling 34 is fixedly mounted to the press frame.

Lower tooling 34 includes die cut edge 36, over which the metal stock enters the tooling at a level generally indicated by line 38. Die cut edge 36, along with die form ring 40 are solidly supported by block member 41 which is in turn supported by base member 43. Additionally, lower tooling 34 includes draw ring 42, positioned between die form ring 40 and die cut edge 36. A center pressure pad 44 is located concentrically within form ring 40. Draw ring 42 is supported by springs 45 (only one shown) mounted in base member 43. Springs 45 are shown in FIG. 3 in a compressed condition, caused by pressure exerted upon draw ring 42 when the tooling is closed. The center pressure pad 44 is supported by spring 47 mounted within pressure pad 44 and base member 43 central to the first station tooling. Spring 47 is also shown in a compressed condition from force exerted by the upper tooling 32.

When the tooling is open, draw ring 42 and center pressure pad 44 are retained in the lower tooling 34 by flanges 49 and 51 integrally machined on the respective tooling portions with draw ring 42 bottoming against die cut edge 36 and center pressure pad 44 against form ring 40. In such case, the uppermost surface of draw ring 42 is at a position some distance below the lowest point of shear on the die cut edge 36, while the uppermost surface of the center pressure pad 44 is some distance above draw ring 42 and below lowest point of shear on die cut edge 36.

Upper tooling 32 is provided with blank punch 46 which is positioned to cooperate with draw ring 42 for compression of spring 45 as the tooling is closed. A knockout and positioner 48 is located above die form ring 40, and punch center 50 is provided with an appropriate configuration to produce the partially completed shell, as well as to clamp a blank in cooperation with center pressure pad 44. Blank punch 46, knockout and positioner 48, and punch center 50 are all closed simultaneously upon lower tooling 34 as the press ram is lowered.

Figure 4:
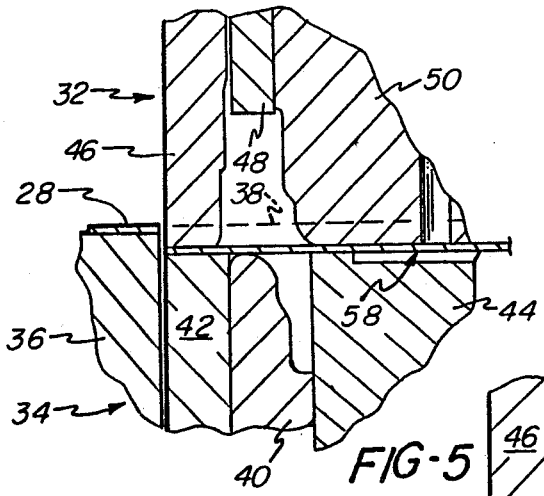
FIGS. 4, 5, 6 and 7 are partial sectional views of a portion of the preferred first station tooling, illustrating operation of the tooling for separating a blank and partially forming the blank into a shell.
Figure 5:
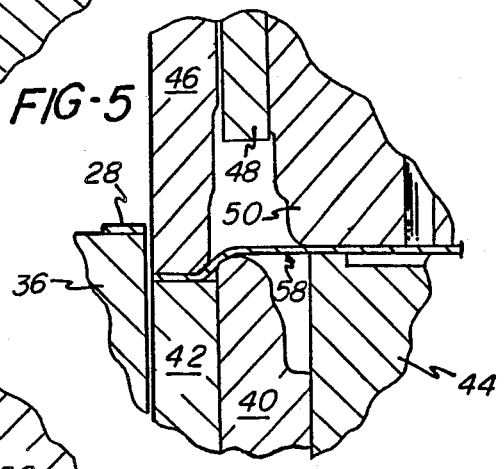

The operation of the first station tooling 30 to produce the blank from the stock and partially form a shell is shown in detail in FIGS. 4–7. In FIG. 4, the tooling is shown already partially closed. The stock 28 initially entered the tooling along a line indicated at 38, and as the press ram is lowered, a flat blank 58 is produced by shearing the stock material between die cut edge 36 and blank punch 46.

As the press ram continues downward, the blank punch 46, knockout and positioner 48, and punch center 50 all continue to move simultaneously. At the point illustrated in FIG. 5, the blank 58 is still pinched between blank punch 46 and draw ring 42, and between punch center 50 and center pressure pad 44, beginning the formation of the shell over die form ring 40. As the blank 58 is formed over form ring 40, it is pulled from between blank punch 46 and draw ring 42.

Figure 6:
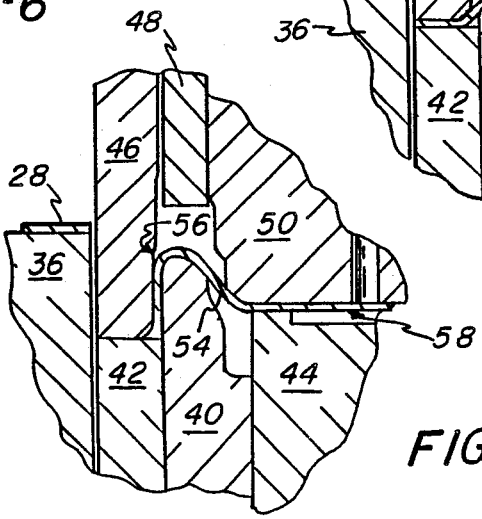

Referring now to FIG. 6, the press ram continues to move downward as the punch center 50 begins to form the panel of shell 58 (heretofore referred to as blank 58). The shell material is no longer held between the bank punch 46 and the draw ring 42, but is still contained between punch center 50 and center pad 44, and the draw ring 42 no longer controls the formation of the shell. The clearance between the inside diameter of the blank punch 46 and the outside diameter of the die form ring 40 is selected to provide an appropriate amount of drag or resistance on the shell 58 to insure proper formation. The upward-extending chuckwall 54 of the completed shell begins to be formed.

Figure 7:
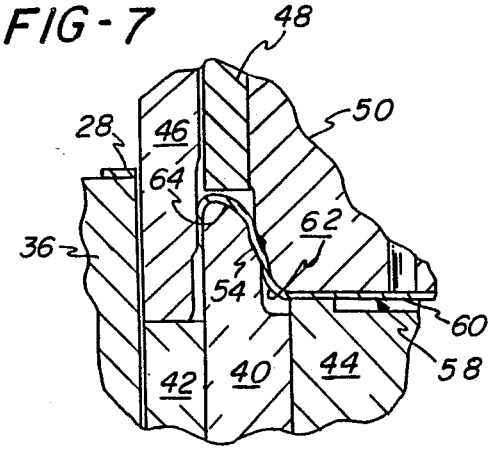

In FIG. 7, the tooling is shown in its closed position with the press ram bottomed against appropriate stop blocks. The first portion of the shell formation operation is completed, with a shell 58 being formed having a flat panel 60 terminating at a relatively large radius area 62. The large radius area 62 forms the junction region of chuckwall 54 with the panel 60, and will later form the shell countersink and panel form radius. A much tighter radius will later be provided for the shell countersink.

The shell is further provided with a lip 64 extending generally outwardly and upwardly from the chuckwall 54, but having general downward curvature. Lip 64 is provided with two distinct curvatures, with the portion adjacent chuckwall 54 having only slight relative curvature and thus providing the upward extension of lip 64. The outermost portion is provided with a relatively sharp downward curvature by die center form ring 40, and the lowermost portion of the outer edge of lip 64 is formed to at least even with, if not above, the point where lip 64 connects with the shell chuckwall 54.

It will be noted that upon closure of the tooling, knockout and positioner 48 does not contact shell 58. Once the forming operation has been completed, the press ram is raised to open the tooling. As the tooling is opened, shell 58 is held within blank punch 46 by the tight fit of shell 58 therein caused during its formation and is carried upward by upper tooling 32. For reasons that will be described in detail below, once the lowermost portion of shell 58 has cleared the stock level indicated in FIG. 4 at 38, knockout and positioner 48 halts its upward movement, while blank punch 46 and punch center 50 continue to rise with the press ram toward the uppermost portion of the press stroke shown in FIG. 8. When the upward movement of knockout and positioner 48 is stopped, shell 58 will contact knockout and positioner 48 which knocks out, or pushes, shell 58 from within the still-moving blank punch 46.

Figure 8:
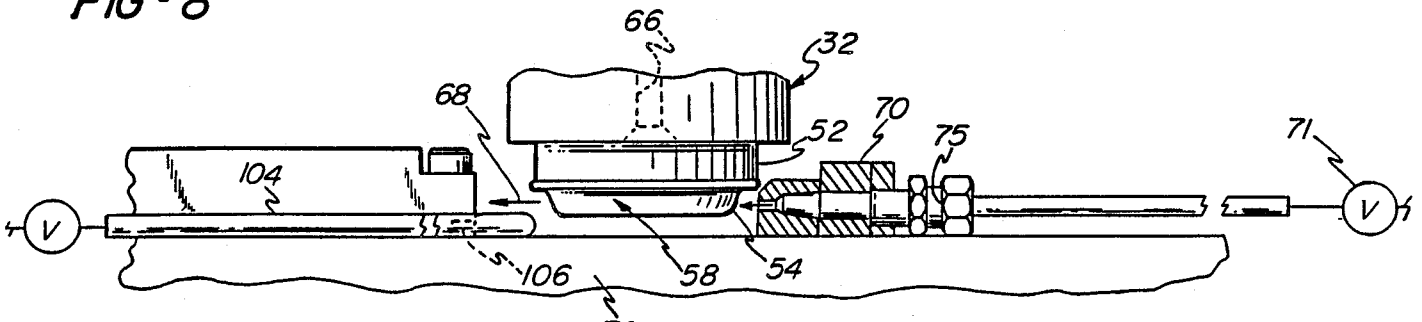
FIG. 8 is a side view of a first tooling station and entrance into the transfer path.

The shell 58 is then held in position on knockout and positioner 48, as shown in FIG. 8, through application of a vacuum to shell 58. A vacuum passage 66 connects with a conventional shop vacuum supply to provide the vacuum to the surface of punch center 50. This vacuum then causes the shell 58 to adhere to the surface of knockout and positioner 48.

Upon completion of the first operation upon the shell, it is moved by the transfer means of the present invention, to be described in detail below, either out of the press or to a corresponding one of a plurality of second stations for completion of the formation process.

At the second station tooling (not shown), the partially completed shell is captured and located within the tooling. The complete transfer and repositioning operation occurs between successive strokes of the press, so that as the press ram is next lowered, the tooling of the second station acts to work the partially completed shell into a finished shell. In carrying out this operation, the tooling clamps the chuckwall of the shell, whereafter a raised central panel is formed into the shell to define a countersink at the base of the chuckwall. Further, the lip is given additional downward curl to properly configure the lip for later seaming to the upper end of a can body. The details regarding this operation, which are not necessary to understand the present invention may be found by reference to the above incorporated U.S. Pat. No. 4,561,280.

Returning now to FIG. 8, once the shell which has been formed within the first station tooling is positioned, the shell 58 is ready to be transferred either to a subsequent tooling station or out of the press. The mechanism through which shell transfer occurs is the impinging of at least one directed blast of preferably compressed air, but alternatively any appropriate pressurized gas, against the chuckwall 54. The blast is sufficient to propel the shell from the tooling in the direction indicated by arrow 68.

The air stream is caused to emerge from manifold 70 which includes air passages therethrough which define at least one nozzle or orifice opening from manifold 70. The air stream is initiated by an air valve 71, connected to a remote source of compressed air. Manifold 70 is secured to the stripper plate 74, positioned near the location for partially completed shells which are supported for transfer.

Also in FIG. 8, a transfer mechanism is shown for moving a partially completed shell from a first station tooling into a transfer path for delivery to a second tooling station where formation is completed. Only upper tooling 32 is shown, it being understood that the cooperating lower tooling is disposed beneath stripper plate 74 with tooling 32 lowered by the press ram through an opening (not shown) in the stripper plate. Manifold 70 is positioned adjacent tooling 32, so that the manifold will be in position to direct at least one stream of air against a shell 58 positioned on the lower, working surface of tooling 32.

Figure 9:
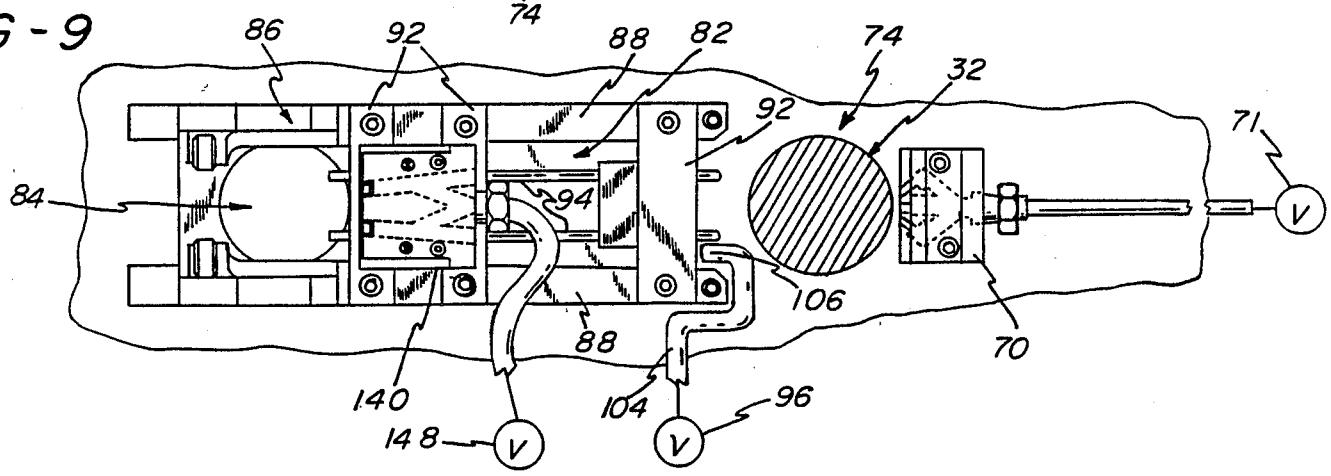
FIG. 9 is a schematic plan view of the first station, transfer path, and a second station.

Referring also to FIG. 9, the shell 58 will be propelled in substantially free flight into the entrance to a transfer path 82 leading to a second tooling station 84. There, the shell is captured and located within appropriate capturing mechanism 86 prior to being operated upon by the second station tooling. Details of the capturing mechanism 86 may be seen by reference to U.S. Pat. No. 4,561,280, which has been incorporated hereinto by reference.

Transfer path 82 is partially enclosed, and is defined by a pair of side walls 88 mounted to stripper plate 74. A pair of cross members 90 and 92 are connected between walls 88, and a pair of polished rails 94 are connected to the underside of each member 90 and 92 to define a top for the transfer path. Because the shell is propelled to travel substantially in free flight along the path, walls 88, plate 74 and rails 94 are provided only to occasionally guide a shell and to prevent shells from inadvertently leaving the transfer path. Normally, a shell does not travel in contact with these surfaces.

A typical length for transfer path 82 from the first station tooling to the second station tooling is in the order of, but not limited to, approximately 10–30 inches (25 to 75 cm).

It is preferred that the compressed air or other pressurized gas be supplied to air driver mechanism 71 be supplied at a pressure of approximately 60–85 psi (4.2 to 6.0 kg/cm$^2$). However, it has also been found that pressures within the range of approximately 25–95 psi (1.7–6.7 kg/cm$^2$) are usable.

It has been found that for particular shapes of shells, and particularly for shells of greater thicknesses heavier materials such as steel, it is advantageous for manifold 70 to define more than one orifice. The multiple orifices form multiple streams of compressed air which are directed against the shell.

Figure 10:
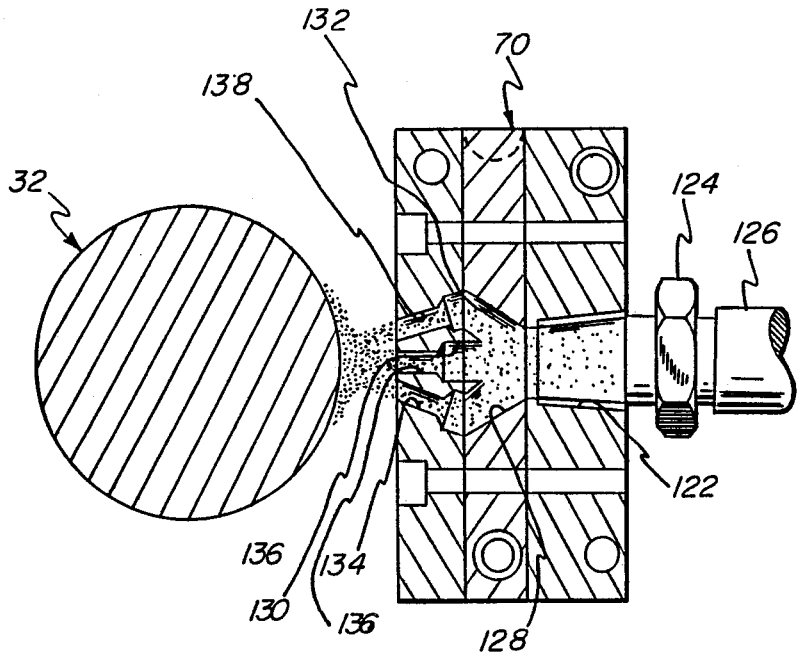
FIG. 10 is a top sectional view of a manifold forming three air orifices for transferring shells in accordance with the invention.

One embodiment for a multiple orifice manifold is shown in FIG. 10. Manifold 70 includes an inlet port 122 into which is located a fitting 124 connected to air supply line 126. From inlet port 122 the internal passageway of manifold 70 branches into three air paths 128, 130 and 132. Each terminates in an orifice or nozzle 134, 136 and 138, respectively. The orifices 134, 136 and 138 are arranged in a converging relationship, directed toward the shell mounted to the bottom surface of the first station tooling 32. The orifices define a convergence point which is near the center of the mounted shell. While it is not critical that the convergence point be at the center of the shell, the air streams emerging from the orifices should not converge prior to reaching the shell, and should preferably not converge until the shell has been moved by the air streams at least some distance. For the example illustrated in FIG. 10, the orifices 134 and 138 are arranged at 15° angles with respect to center orifice 136.

Manifold 70 is preferably formed from steel, and in such case may be made in three pieces as shown in FIG. 10 for ease of machining. However, it will be recognized that manifold 70 may be formed in other manners, for example, by molding the manifold from plastic.

Figure 11:
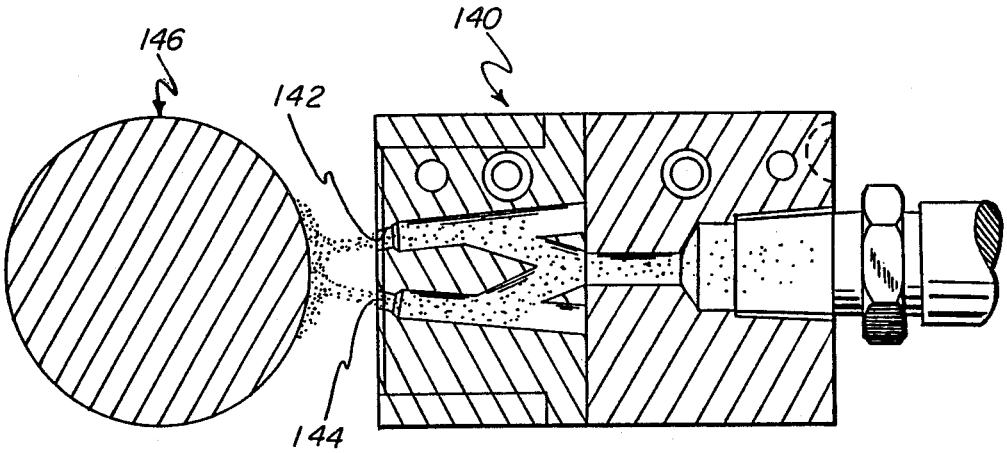
FIG. 11 is a top sectional view of an alternative manifold forming two air orifices for transferring shells.

A second embodiment for the manifold may be seen by reference to FIG. 11. In this case, manifold 140 provides only two orifices 142 and 144 directed towards a shell carried on the bottom of a tooling 146. The arrangement of the orifices is such that they define lines of convergence which meet at about the center of the supported shell. In the particular embodiment shown, the relative angle between the orifices is 10°.

After a shell has been transferred from the first tooling station, and captured and worked into its final form at second station 84 (FIG. 9), the shell must be removed from the second station and out of the press. Accordingly, a manifold 140 is mounted adjacent tooling station 84, connected to the compressed air supply via valve 148. Thus, as the second station tooling is raised to lift the completed shell to a ready position, air is directed from the orifices of manifold 140 to propel the shell from the tooling station and out of the press.

Further details regarding the detailed structure of the second station tooling may be seen by reference to the incorporated U.S. Pat. No. 4,561,280.

In the case of manifold 140, only two orifices are needed since transfer times out of the second station are less critical than from the first station. This is due to the fact that a shell transferred from the first station must be positioned within the second station tooling prior to the next press stroke, whereas a shell transferred from the second station need only clear the press prior to the next stroke.

While embodiments have been specifically disclosed having two and three orifices within a single manifold, it will be recognized that four or more orifices could be useful in some applications. Further, other angular relationships between the orifices could be used, so long as the orifices are arranged to reliably propel the shell along the desired transfer path.

The orifices for manifolds 120 and 140 have a preferred dimension of 0.120 inches (0.305 cm), but it has been found that adequate transfer can be obtained with an orifice size ranging from 0.060–0.140 inches (0.150–0.350 cm). The manifold orifice is preferably circular, but may be of other shapes.

The duration for which air valve 71 is energized to direct air through manifold 70 is dependant upon the distance over which the shell is to be transferred, as well as the size of the shell. Thus, this duration may vary over a relatively wide range. However, for several working embodiments of the apparatus disclosed herein, duration times vary between approximately 0.040 and 0.140 seconds.

Details regarding valve 71 and control of the valve will be described in detail below.

It has been found to be helpful to use, as part of the transfer apparatus, an air assist mechanism along the transfer path. The assist mechanism may be seen by reference to FIG. 9. An air valve 96 which may be similar in construction to air valve 71 directs air to the assist mechanism from a reduced source of compressed air or other pressurized gas, preferably a source of 25 to 50 p.s.i. (1.7 to 3.5 kg/cm$^2$). Valve 96 is in turn connected to a conduit 104 extending downwardly along the exterior of one side wall 88. Conduit 104 curves around the end of wall 88 to the entrance to transfer path 82, where conduit 104 terminates in an open end. At the open end, a nozzle 106 is formed consisting preferably of simply a flattened portion of conduit for focusing the air emerging from the conduit. Nozzle 106 is positioned adjacent the inner surface of wall 88 and against base plate 74, and is directed down path 82 in the direction of shell movement.

Valve 96 is actuated to permit air flow through conduit 104 just after a shell has entered into the transfer path 82, and air flow is continued until the shell has completed its movement along the path to the second tooling station. It has been found that the air supplied in such a manner provides a pushing force behind the shell as the shell effectively rides the air stream, as well as some turning motion to the shell as a result of the application of air at one side of the transfer path. Further, it is believed that the air stream provides a cushion upon which the shell is at least partially supported. These effects have been found to be beneficial in facilitating shell movement along path 82 for transfer. Specifically, shell speed is increased, and the direction of the moving shell is more closely regulated to decrease contact with the structure defining the transfer path.

The transfer mechanism as shown in FIGS. 8 and 9, particularly the air driver mechanism, is specifically adapted to carry out the transfer of a shell from a first station tooling to a second station tooling within the same press. Of course, the present invention is not limited solely for such a transfer, but rather can be used for any shell transfer, or for transfers of other relatively flat objects moving in edgewise fashion. In a shell press having a two-stage tooling arrangement, such as that shown in FIG. 9, it is anticipated that a similar air assist mechanism may be used in conjunction with the shell transfer mechanism moving shells from the second station tooling station out of the press.

Figure 12:
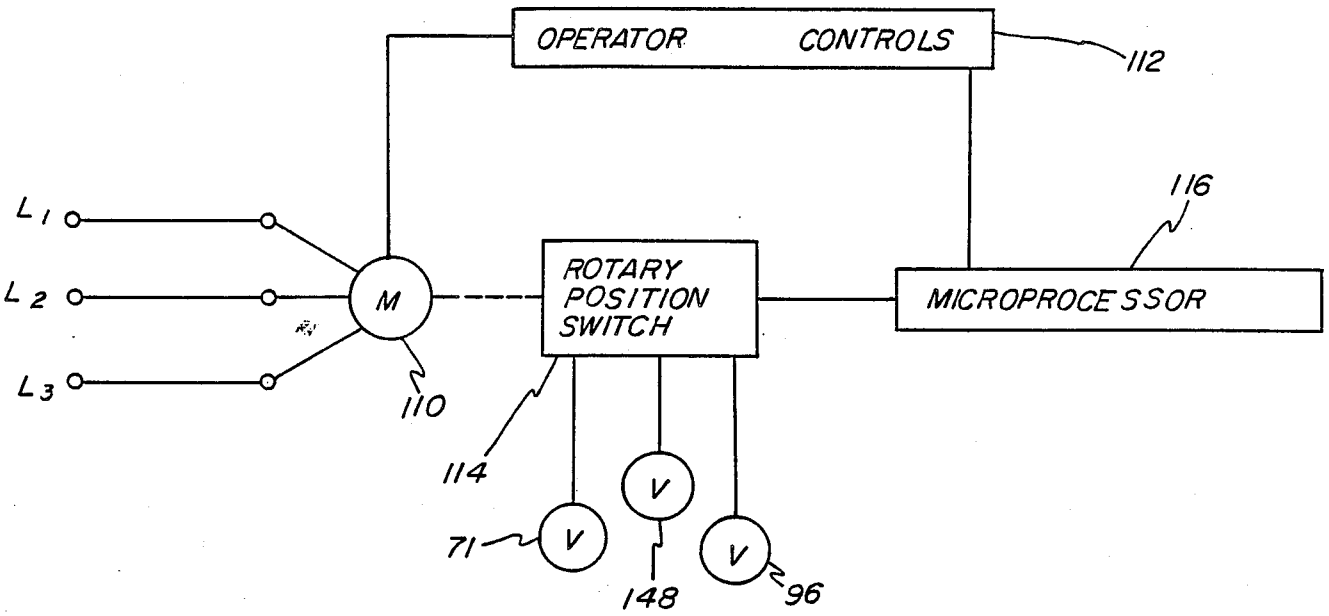
FIG. 12 is a diagram illustrating schematically the control system for operation of the press.

The electrical control means for controlling operation of the press for the manufacture of shells is shown schematically in FIG. 12. Power is supplied to main drive motor 110 through lines L1, L2 and L3 for driving the press ram to open and close the tooling of the first and second stations. A series of operator controls 112, which may be mounted on one or more conveniently located control panels, enable the press operator to control stopping, starting and speed of the press, as well as to control and monitor various other press functions.

A number of press functions are controlled by a programmable rotary position switch 114 that provides a variety of separate switching functions, each of which may be adjusted to open and close switching contacts at predetermined angular positions of the press crank. Rotary switch 114 is mounted for operation to the press frame, and is coupled to the rotary press ram drive through a drive chain or the like, and hence is coupled indirectly to motor 110 as indicated in FIG. 12. The switch is connected to the ram drive so that the switch position designated 0° coincides with the uppermost position of the press ram stroke. The electrically operated functions of the press are directed by a microprocessor 116 which interfaces with operator controls 112 and rotary position switch 114. The microprocessor 116 is programmed to control various press functions in proper timing and sequence.

As has been described, each partially completed and completed shell formed by the press is transferred from a press tooling station by directing a stream of air against the shell through manifold 70 or manifold 140. Each manifold 70 or 140, as well as each air assist nozzle 106 is in turn controlled by a corresponding air valve 71, 96 or 148, the valves being electrically connected for control purposes to rotary position switch 114 as shown in FIG. 12. The valves are actuated at the appropriate points in each press stroke by rotary position switch 114. In this way, the shells are transferred only when the press toolings are in correct position for transfer.

Figure 13:
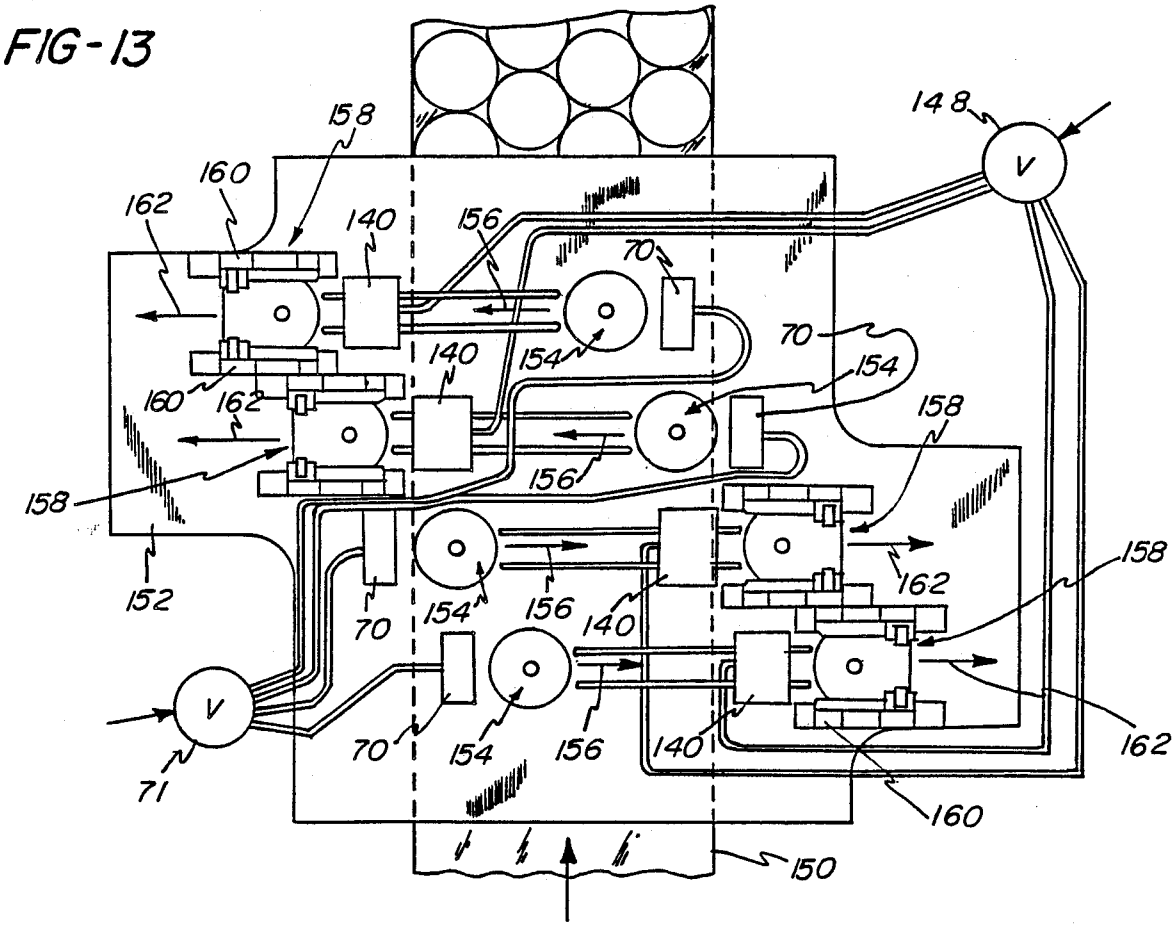
FIG. 13 is a plan view of a press adapted to produce four shells for each press stroke.

A press such as that described herein can be provided with multiple tooling sets to produce a plurality of shells with each stroke. A plurality of first station toolings and a corresponding number of second station toolings and transfer apparatus can be arranged on the press bed so that each stroke produces one shell for each tooling set. An example of such a press which produces four shells per stroke is shown in FIG. 13.

Sheet stock 150 is fed into the press beneath stripper plate 152 supporting the transfer apparatus. Four first stations 154 are provided for severing a blank from the stock 150 and partially forming the shell. Each of first stations 154 includes a corresponding three-orifice manifold 70. (A manifold having one, two, four or more orifices could also be used, depending upon the length of transfer.) Following completion of the operation at each first station, air flow through the corresponding manifold is initiated to transfer the shell along the transfer path as indicated by arrows 156 to a corresponding second station 158.

At each second station 158, a capturing mechanism 160 operates to accurately position the shell within the lower tooling of the second station. During the next stroke of the press following that which partially formed the shells at the first stations, the tooling at each second station 158 closes, thereby completing formation of each shell. Following opening of the tooling, a corresponding two-orifice manifold 140 is actuated to transfer the completed shells from each of the second stations 158, as indicated by arrows 162. (Here also, a manifold having one or three or more orifices could also be used, depending upon the length of transfer.)

Because the toolings at each of first stations 154 and second stations 160 are identical, and because the transfer paths are also identical, air flow through all manifolds 70 is initiated simultaneously and air flow through all manifolds 140 is initiated simultaneously. As a result, it is possible to use a single valve 71 for all manifolds 70 and a single valve 148 for all manifolds 140. Such an arrangement is illustrated in FIG. 13, and is advantageous in that the number of valves is reduced over individual valves for each manifold. Further, the system complexity is reduced since only air lines need extend into the press tooling area; the electrical wiring necessary for control may be kept clear of this area. Servicing of the valves is also facilitated, since the valves may be mounted in any convenient location.

While not shown in FIG. 13, a single valve may also be used to initiate air flow through any air assist mechanisms which may be installed as part of the press toolings.

An appropriate and preferred valve for use in controlling air flow through multiple manifolds is commercially available from Ross Operating Valve Co. of Troy, Michigan under part no. W6076B4321. An appropriate mounting base from the same source is sold under part no. W409B91. Such valve is a four-way valve, having one inlet port, two outlet ports and two exhaust ports. Of course, many other commercially available valves are appropriate for use with the present invention.

In the particular embodiments disclosed herein, including that shown in FIG. 13, rotary position switch 114 causes valve 71 to be energized whenever switch 114 reaches an appropriate rotational position with respect to selected actuation times. For example, in one working embodiment of the invention, valve 71 may be actuated whenever rotary switch 114 reaches the position of 277°. It should be noted that this position for rotary switch 114 will occur when the press ram has completed most of its upward stroke and the shell has been properly positioned. Each shell will then be struck with a blast of air from manifold 70 and will be transferred away from its respective tooling station.

In an alternative embodiment, valve 71 may be actuated whenever rotary switch 114 reaches the position of 220°. This initiates air flow prior to arrival of the shell in the proper ready position for transfer. However, particularly in the case of steel or other relatively heavy shells, advance of the air initiation insures that adequate air flow is present when the shell in fact reaches the ready position. This has been found to improve transfer reliability. By comparing FIG. 7, it can be seen that as the tooling is raised, blank punch 46 will shield the shell from air flow until blank punch 46 is lifted above the level of the supported shell. At such time, however, the shell will have been properly positioned. (At the second station, no such shielding occurs.)

Valve 71 is controlled to discontinue the air stream emerging from manifold 70 at a crank position of 0°.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. Apparatus for transferring a relatively flat object from a work station along a transfer path, comprising:

means located within the work station for locating the object in a ready position at one end of the transfer path by causing an upper surface of the object to adhere to said locating means, whereby the object is unsupported along a lower surface thereof;

means defining a plurality of orifices located on the opposite side of said ready position from said transfer path, each directed toward said ready position at an angular relationship with respect to the others of said orifices such that gas flow from said orifices converge toward the object and propel the object along the transfer path;

manifold means interconnecting said orifices;

supply means connected to said manifold means for connecting said orifices to a source of pressurized gas;

valve means disposed within said supply means for initiating and discontinuing flow of pressurized gas through said orifices; and control means for controlling said valve means to direct a stream of pressurized gas through said orifices toward said ready position at least when an object is located in said ready position, thereby causing the transfer of said object in free flight from the work station.

2. Apparatus as defined in claim 1, wherein said orifice defining means defines outlet orifices having a cross-sectional area.

3. Apparatus as defined in claim 2, wherein said cross-sectional areas are circular.

4. Apparatus as defined in claim 2, wherein said cross-sectional area of each of said orifices is within the range of approximately 0.060–0.140 inches (0.150–0.350 cm).

5. Apparatus as defined in claim 1, wherein said source of pressurized gas supplies compressed air.

6. Apparatus as defined in claim 5, wherein said compressed air is supplied at a pressure within the range of 25–95 psi (1.7 to 6.7 kg/cm$^2$).

7. Apparatus as defined in claim 1, wherein said orifices define said mutually converging paths to converge near the center of an object supported in said ready position.

8. Apparatus for transferring a relatively flat object from a work station along a transfer path, comprising:

means located within the work station for locating the object into a ready position by causing an upper surface of the object to adhere to said locating means, whereby the object is unsupported along a lower surface thereof;

orifice defining means located adjacent to said ready position for defining an orifice directed toward said ready position;

supply means connected to said orifice defining means for connecting said orifice defining means to a source of pressurized gas;

valve means disposed within said supply means for initiating and discontinuing flow of pressurized gas through said orifice defining means; and control means for controlling said valve means to a direct stream of pressurized gas through said orifice defining means prior to location of an object in said ready position, whereby the transfer of said object in free flight from the work station is caused as the object is released at said ready position.

9. Apparatus as defined in claim 8, wherein said object locating means includes a lower surface, said lower surface defining therein a vacuum opening, and a source of vacuum connected to said vacuum opening, the object being caused to adhere to said lower surface by application of vacuum thereto.

10. Apparatus as defined in claim 9, wherein said object locating means is a portion of a vertically-acting, reciprocating tooling set for working upon the object, said lower surface being defined on an upper tooling of said set.

11. Apparatus as defined in claim 10, wherein said ready position is defined within the upper portion of a stroke of said tooling set.

12. Apparatus as defined in claim 10, wherein said tooling set includes a blank punch disposed as the outermost portion of said tooling set, said blank punch being constructed to punch a blank from a sheet of stock material, said object locating means being defined on a portion of said tooling set disposed radially inward of said blank punch.

13. Apparatus as defined in claim 12, wherein said blank punch is raised to its uppermost stroke position subsequent to location of said object locating means at said ready position, whereby said blank punch shields the object from said stream of pressurized gas until said blank punch is raised past said ready position.

14. Apparatus as defined in claim 8, wherein said source of pressurized gas supplies compressed air.

15. A method for transferring a relatively flat object from a work station along a transfer path, comprising the steps of:

locating the object within the work station in a ready position by securing an upper surface of the object, whereby the object is unsupported along a lower surface thereof;

prior to locating the object in said ready position, initiating flow of pressurized gas through orifice means located adjacent to and directed toward said ready position, thereby causing the transfer of said object in free flight from the work station when the object is released at the ready position; and discontinuing flow of pressurized gas through said orifice means when the object has traversed the transfer path.

16. The method as defined in claim 15, further including shielding the object from said stream of pressurized gas as the object is moved into said ready position, and discontinuing said shielding after the object is located in said ready position.

* * * * *